US009459054B2

(12) United States Patent
Huang et al.

(10) Patent No.: US 9,459,054 B2
(45) Date of Patent: Oct. 4, 2016

(54) HEAT EXCHANGER FOR COOLING BULK SOLIDS

(75) Inventors: Xingcun Huang, Richmond Hill (CA); Ashley Dean Byman, De Winton (CA)

(73) Assignee: SOLEX THERMAL SCIENCE INC., Calgary (CA)

( * ) Notice: Subject to any disclaimer, the term of this patent is extended or adjusted under 35 U.S.C. 154(b) by 1038 days.

(21) Appl. No.: 13/464,793

(22) Filed: May 4, 2012

(65) Prior Publication Data

US 2013/0292093 A1 Nov. 7, 2013

(51) Int. Cl.

| | |
|---|---|
| ***F28D 15/00*** | (2006.01) |
| ***F28F 9/02*** | (2006.01) |
| ***F28F 3/00*** | (2006.01) |
| ***F28D 7/02*** | (2006.01) |
| ***F28D 9/00*** | (2006.01) |
| ***F28F 3/04*** | (2006.01) |
| ***F28F 3/14*** | (2006.01) |
| *F28D 21/00* | (2006.01) |

(52) U.S. Cl.

CPC ..... *F28D 9/0081* (2013.01); *F28D 9/00* (2013.01); *F28F 3/044* (2013.01); *F28F 3/14* (2013.01); *F28F 9/0265* (2013.01); *F28F 9/0275* (2013.01); *F28D 2021/0045* (2013.01); *F28F 2265/10* (2013.01)

(58) Field of Classification Search

CPC ..... F28F 3/12; F28F 3/08; F28F 3/14; F28F 9/0275; F28F 3/044; F28F 2265/10; F28F 9/0265; F28F 9/0246; F28F 2009/0297; F28F 2009/0285; F28F 2265/00; F28F 2265/02; F28D 15/00; F28D 7/00; F28D 9/0081; F28D 9/00; F28D 2021/0045

USPC ..... 165/166, 167, 104.15, 168, 134.1, 173, 165/175, 176

See application file for complete search history.

(56) References Cited

U.S. PATENT DOCUMENTS

| | | | | |
|---|---|---|---|---|
| 3,397,460 A | | 8/1968 | Hall | |
| 4,253,520 A | * | 3/1981 | Friedericy | F28D 9/0031 165/134.1 |

(Continued)

FOREIGN PATENT DOCUMENTS

| | | |
|---|---|---|
| DE | 3317204 C1 | 10/1984 |
| EP | 1712309 A1 | 10/2006 |

(Continued)

OTHER PUBLICATIONS

Australian Office Action dated Dec. 9, 2010, issued in Australian patent application No. 2007247801.

(Continued)

*Primary Examiner* — Allen Flanigan
*Assistant Examiner* — Claire Rojohn, III
(74) *Attorney, Agent, or Firm* — Borden Ladner Gervais LLP; Geoffrey deKleine

(57) ABSTRACT

A heat exchanger includes a housing including an inlet for receiving bulk solids, and an outlet for discharging the bulk solids. A plurality of spaced apart, substantially parallel heat transfer plate assemblies are disposed in the housing between the inlet and the outlet for cooling the bulk solids that flow from the inlet, between adjacent heat transfer plate assemblies, to the outlet. Ones of the plurality of heat transfer plate assemblies including a heat transfer plate and a pipe extending along a top end of the heat transfer plate to protect the heat transfer plate.

33 Claims, 6 Drawing Sheets

(56) References Cited

U.S. PATENT DOCUMENTS

| | | | | |
|---|---|---|---|---|
| 4,292,743 | A | 10/1981 | Razus | |
| 4,424,634 | A | 1/1984 | Westelaken | |
| 4,679,620 | A | 7/1987 | Daun | |
| 5,167,274 | A * | 12/1992 | Mueller | B01J 2/04 165/170 |
| 6,328,099 | B1 | 12/2001 | Hilt et al. | |
| RE37,653 | E | 4/2002 | Anderson | |
| 7,143,822 | B2 * | 12/2006 | Wisniewski | F28D 1/0443 165/140 |
| 2003/0159816 | A1 * | 8/2003 | Kodumudi | F28F 9/027 165/176 |
| 2005/0257921 | A1 * | 11/2005 | Hu | F28D 1/0443 165/140 |
| 2007/0256316 | A1 | 11/2007 | Jordison et al. | |
| 2008/0314574 | A1 * | 12/2008 | Filippi | B01J 8/0257 165/167 |

FOREIGN PATENT DOCUMENTS

| | | | |
|---|---|---|---|
| GB | 2422004 | A | 7/2006 |
| JP | 2001041655 | A | 2/2001 |
| JP | 2003269822 | A * | 9/2003 |
| WO | 03001131 | A1 | 1/2003 |

OTHER PUBLICATIONS

International Search Report and Written Opinion, issued in International patent application No. PCT/CA2013/050298 dated Jul. 17, 2013.

Extended European Search Report dated Sep. 8, 2015, issued in respect of corresponding European Application No. 13784266.2.

* cited by examiner

HEAT EXCHANGER FOR COOLING BULK SOLIDS

FIELD OF THE INVENTION

The present disclosure relates to a heat exchanger for cooling bulk solids.

BACKGROUND

Heat exchangers use indirect cooling plates to cool bulk solids that flow, under the force of gravity, through the heat exchanger. While known heat exchangers may be used to cool bulk solids having temperatures up to 400° C., these heat exchangers are unsuitable for cooling high temperature bulk solids that have temperatures above 400° C. Improvements to heat exchangers are therefore desirable.

SUMMARY

According to the one aspect of an embodiment, a housing including an inlet for providing bulk solids, and an outlet for discharging the bulk solids, a plurality of spaced apart, substantially parallel heat transfer plate assemblies disposed in the housing between the inlet and the outlet for cooling the bulk solids that flow from the inlet, between adjacent heat transfer plates, to the outlet, ones of the plurality of heat transfer plate assemblies including a heat transfer plate and a pipe extending along an inlet end of the heat transfer plate to protect the heat transfer plate.

BRIEF DESCRIPTION OF THE DRAWINGS

Embodiments of the present invention will be described, by way of example, with reference to the drawings and to the following description, in which.

DETAILED DESCRIPTION OF THE PREFERRED EMBODIMENTS

Figure 1:
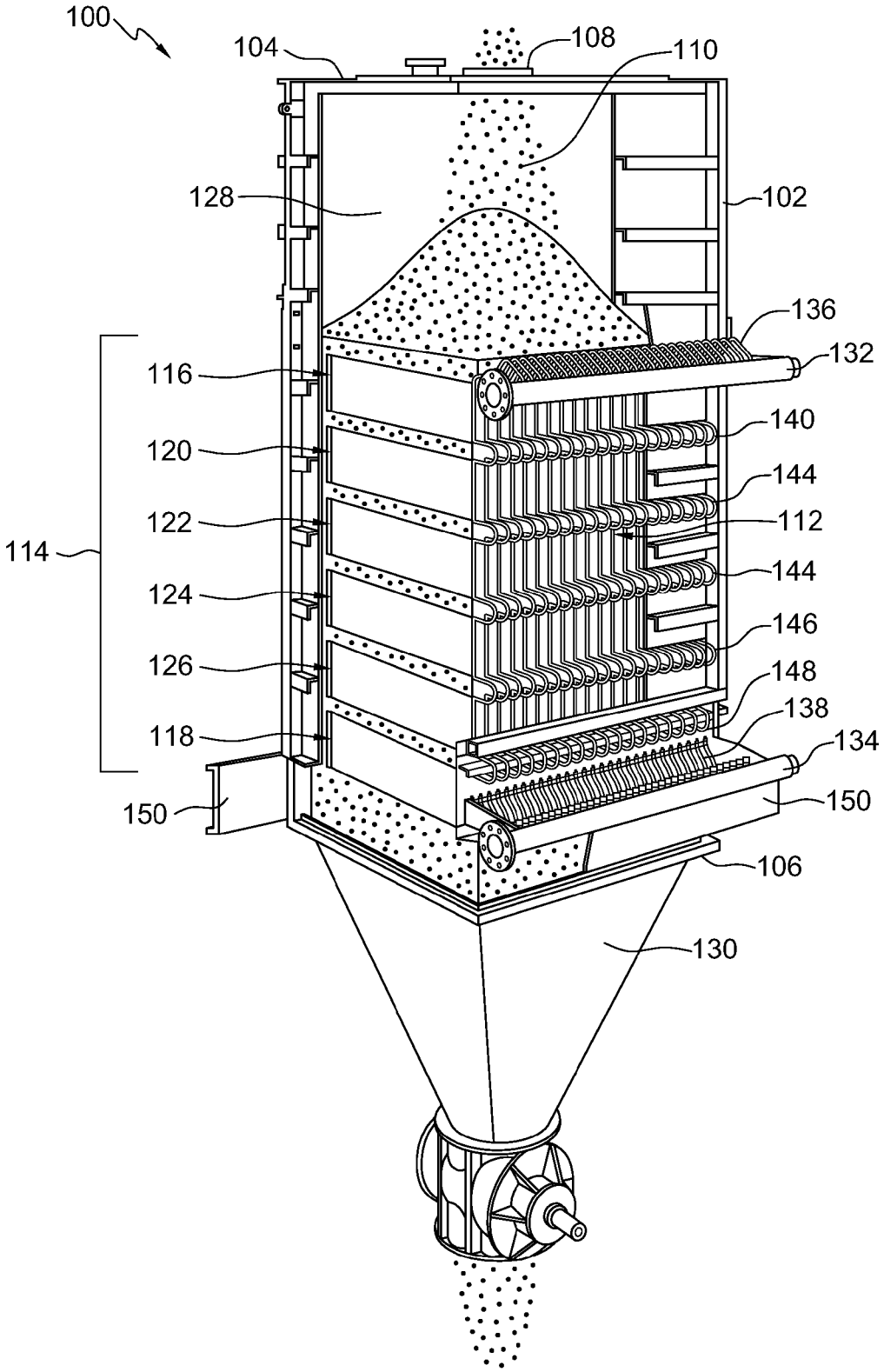
FIG. 1 is a partially cut away perspective view of a heat exchanger for cooling bulk solids in accordance with an embodiment.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

The disclosure generally relates to heat exchangers for cooling bulk solids. Examples of bulk solids include metal powders, ash, coke, coals, carbon powders, graphite powders, and other solids that flow under the force of gravity.

A partially cutaway perspective view of an embodiment of a heat exchanger for cooling bulk solids is shown in FIG. 1. The heat exchanger 100 includes a housing 102 with a generally rectangular cross-section. The housing 102 has a top 104 and a bottom 106. The top 104 of the housing 102 includes an inlet 108 for introducing bulk solids 110 into the heat exchanger 100. The bottom 106 of the housing 102 is open to provide an outlet (not shown) for discharging cooled bulk solids 110 from the housing 102 to an optional discharge hopper 130, and out of the heat exchanger 100. A plurality of heat transfer plate assemblies 112 are disposed within the housing 102, between the inlet 108 and the outlet. The heat transfer plate assemblies 112 are spaced apart and arranged generally parallel to each other in rows, referred to herein as banks. In the example shown in FIG. 1, the heat exchanger 100 includes six banks of heat transfer plate assemblies 112. The six banks are arranged in a stack 114. The stack 114 includes a top bank 116, a bottom bank 118, and four intermediate banks 120, 122, 124, and 126. For the purpose of the present example, each bank includes fifteen heat transfer plate assemblies 112. Although the heat exchanger 100 of FIG. 1 includes six banks, other suitable numbers of banks may be utilized. Also, other suitable numbers of heat transfer plate assembles 112 in each bank may be utilized.

The entire stack 114, including six banks of heat transfer plate assemblies 112 are supported on support channels 150 at the bottom of the stack 114. The support channels support the stack and the weight of the bulk solids 110 introduced into the heat exchanger 100 as the weight of the bulk solids is transferred to the heat transfer plate assemblies 112 via friction.

Figure 2:
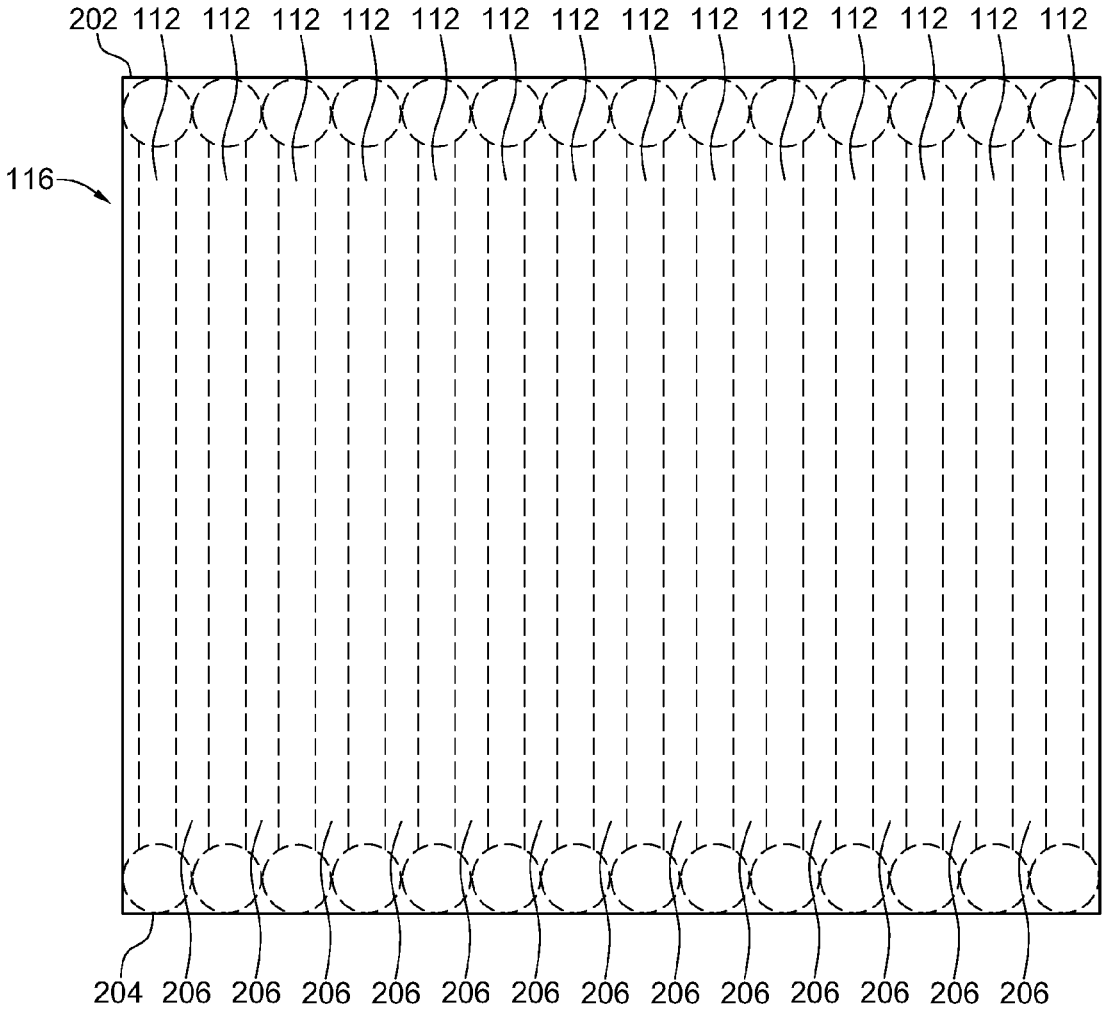
FIG. 2 is a top view of a top bank of heat transfer plate assemblies of the heat exchanger of FIG. 1.

Referring to FIG. 2, a top view of the top bank 116 of heat transfer plate assemblies 112 of the heat exchanger 100 of FIG. 1 is shown. Each heat transfer plate assembly 112 of the top bank 116 extends the width of the housing 102 between a first sidewall 202 of the housing 102 and an opposing second sidewall 204 of housing 102. The heat transfer plate assemblies 112 are arranged generally parallel to each other with spaces between adjacent heat transfer plate assemblies 112 to provide passageways 206 for bulk solids 110 to flow through. Insulation 205 is disposed between a third sidewall 206 of the housing 102 and the heat transfer plate assembly 112 located adjacent to the third sidewall 206, to protect the third sidewall 206 from wear caused by the flow of the bulk solids 110, by inhibiting bulk solids from flowing into the space between the third sidewall 206 and the adjacent heat transfer plate assembly 112. Insulation 205 is also disposed between a fourth sidewall 208, and the heat transfer plate assembly 112 located adjacent to the fourth sidewall 206, to protect the fourth sidewall 208 from wear caused by the flow of the bulk solids 110, by inhibiting bulk solids from flowing in the space between the fourth sidewall 208 and the adjacent heat transfer plate 112 assembly. The insulation 205 may be a ceramic fiber sheet of suitable thickness that inhibits the flow of bulk solids 110 in the spaces between the third sidewall 206 and the adjacent heat transfer plate 112 assembly, and the fourth sidewall 208 and the adjacent heat transfer plate 112 assembly, respectively. The bottom bank 118 and the four intermediate banks 120, 122, 124, and 126 have a similar configuration as the top bank 116.

The six banks 116, 118, 120, 122, 124, and 126 of heat transfer plate assemblies 112 may be aligned in columns in the housing 102 such that the passageways 206 extend through the entire stack 114. Alternatively, the heat transfer plate assemblies 112 in the six banks 116, 118, 120, 122, 124, and 126 may be arranged such that the heat transfer plate assemblies 112 are offset from one another when the six banks 116, 118, 120, 122, 124, and 126 are aligned in columns in the housing 102.

Referring again to FIG. 1, the top bank 116 of the stack 114 (i.e. the bank that is located closest to the inlet 108) is sufficiently spaced from the inlet 108 to provide a hopper 128 in the housing 102 between the inlet 108 and the top bank 116. The hopper 128 facilitates distribution of bulk solids 110 that flow from the inlet 108, as a result of the force of gravity, over the heat transfer plate assemblies 112 of the top bank 116. The bottom bank 118 (i.e. the bank that is located closest to the outlet of the stack 116 is sufficiently spaced from the outlet) to facilitate the flow of bulk solids 110 through the outlet. A discharge hopper 130 may be utilized at the outlet to create a mass flow or "choked flow" of bulk solids and to regulate the flow rate of the bulk solids 110 through the heat exchanger 100. An example of a discharge hopper 130 is described in U.S. Pat. No. 5,167,274. The term "choked flow" is utilized herein to refer to a flow other than a free fall of the bulk solids 110 as a result of the force of gravity.

The heat exchanger 100 also includes a cooling fluid inlet manifold 132 and cooling fluid discharge manifold 134. The cooling fluid inlet manifold 132 is coupled to the housing 102 and is in fluid communication with each heat transfer plate assembly 112 of the top bank 116 of the stack 114. A respective fluid line 136 extends from each heat transfer plate assembly 112 of the top bank 116 to the cooling fluid inlet manifold 132. The cooling fluid discharge manifold 134 is coupled to the housing 102 and is in fluid communication with each heat transfer plate assembly 112 of the bottom bank 118 of the stack 114. A respective fluid line 138 extends from each heat transfer plate assembly 112 of the bottom bank 118 to the cooling fluid inlet manifold 134.

In the example of FIG. 1, the heat transfer plate assemblies 112 of the top bank 116, the bottom bank 118, and the four intermediate banks 120, 122, 124, and 126 are arranged in columns. The heat transfer plate assemblies 112 of each column are in fluid connection with each other. For example, a respective fluid line 140 extends from each heat transfer plate assembly 112 of the top bank 116 to a respective heat transfer plate assembly 112 of the intermediate bank 120 of the same column. A respective fluid line 142 extends from each heat transfer plate assembly 112 of the intermediate bank 120 to a respective heat transfer plate assembly 112 of the intermediate bank 122 of the same column. A respective fluid line 144 extends from each heat transfer plate assembly 112 of the intermediate bank 122 to a respective heat transfer plate assembly 112 of the intermediate bank 124 of the same column. A respective fluid line 146 extends from each heat transfer plate assembly 112 of the intermediate bank 124 to a respective heat transfer plate assembly 112 of the intermediate bank 126 of the same column. A respective fluid line 148 extends from each heat transfer plate assembly 112 of the intermediate bank 126 to a respective heat transfer plate assembly 112 of the bottom bank 118 of the same column.

Figure 3:
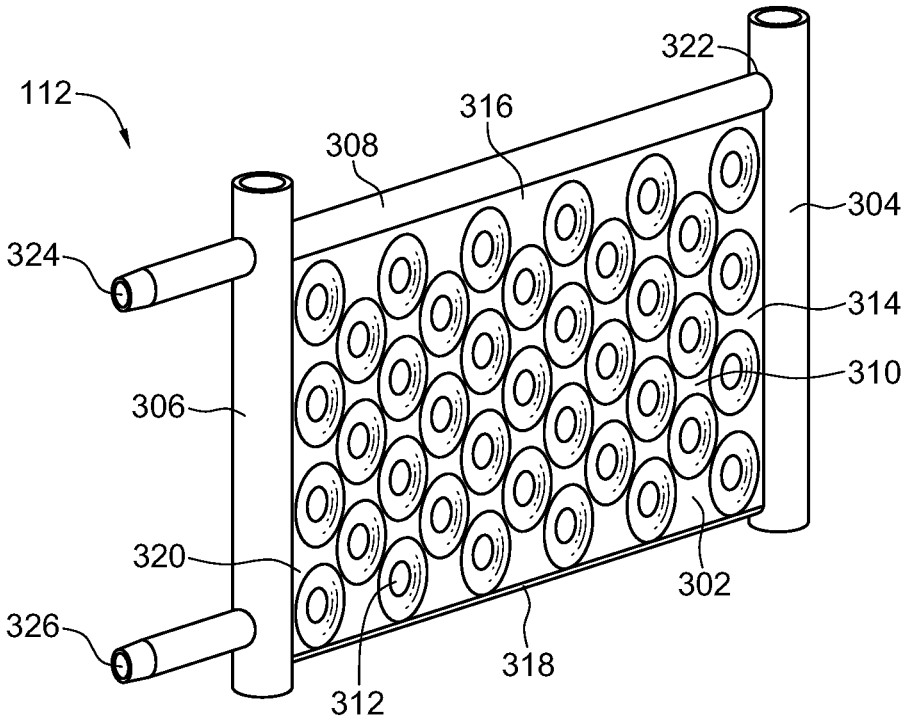
FIG. 3 is a perspective view of an example of a heat transfer plate assembly of the heat exchanger of FIG. 1.

A perspective view of an example of a heat transfer plate assembly 112 is shown in FIG. 3. The heat transfer plate assembly 112 includes a heat transfer plate 302, a first fluid conduit 304, a second fluid conduit 306, and a pipe 308. The term pipe is utilized herein to refer to a conduit through which fluid may flow. The pipe 308 is not limited to a cylindrical pipe and may be any other suitable shape to facilitate fluid flow therethrough.

The heat transfer plate 302 includes a pair of metal sheets 310. The sheets 310 may be made from stainless steel, such as 316L stainless steel. The two sheets of the pair of sheets 310 are arranged generally parallel to each other. The two sheets are welded together at locations on each sheet. The two sheets 310 are also seam welded along the bottom edges of the two sheets. After the two sheets 310 are welded together, the sheets are inflated such that generally circular depressions 312 are formed on each sheet. The generally circular depressions 312 are distributed throughout each sheet and are located at complementary locations on each sheet such that the depressions 312 on one of the sheets are aligned with the depressions 312 on the other of the sheets. When the sheets 310 are inflated, spaces are provided between the sheets 310 in areas where the sheets 310 are not welded together.

The first fluid conduit 304 extends along a first side 314 of the heat transfer plate 302, at least between a top end 316 and a bottom end 318 of the heat transfer plate 302. The first fluid conduit 304 is welded to first side edges of each of the sheets 310. The second fluid conduit 306 extends along an opposing second side 320 of the heat transfer plate 302, at least between the top end 316 and the bottom end 318 of the heat transfer plate 302. The second fluid conduit 306 is welded to opposing second side edges of each of the sheets 310.

The pipe 308 extends along the top end 316 of the heat transfer plate 302. A first end 322 of the pipe 308 is in fluid communication with the first fluid conduit 304. The pipe 308 passes through the second fluid conduit 306. The pipe 308 may be in fluid communication with a top portion 410 (shown in FIG. 4) of the second fluid conduit 306. A second end 324 of the pipe 308 extends from second fluid conduit 306 to provide a cooling fluid inlet. The pipe 308 is welded to the top edges of each of the sheets 310. The pipe 308 may be have a diameter that is slightly less than or equal to the thickness of the heat transfer plate 302 to facilitate the flow of cooling fluid into the heat transfer plate 302, and to facilitate the flow of bulk solids 110 past the heat transfer plate 302.

The terms top and bottom are utilized herein to provide reference to the orientation of the heat exchanger plate assemblies 112 and the heat exchanger 100 when assembled.

Referring again to FIG. 3, the heat transfer plate assembly 112 also includes a cooling fluid outlet 326. The cooling fluid outlet 326 is located near the bottom end 318 of the heat transfer plate 302. The cooling fluid outlet 326 extends substantially perpendicular to and away from the second fluid conduit 306. The cooling fluid outlet 326 is in fluid communication with the second fluid conduit 306.

The first fluid conduit 304 and the second fluid conduit 306 each have a diameter that is larger than the diameter of the pipe 308. When the heat transfer plate assemblies 112 are arranged in a bank, the first fluid conduits 304 and the second fluid conduits 306 of adjacent heat transfer assemblies 112 abut each other, as shown in FIG. 2. The diameters of the first and second fluid conduits 304, 306 may be larger than the diameter of the pipe 308 to space apart the heat transfer plates 302 of adjacent heat transfer plate assemblies 112 when the heat transfer plate assemblies 112 are arranged in a bank. Alternatively, the diameters of the first and second fluid conduits 304, 306 may be equal to or less than the diameter of the pipe 308.

When the six banks 116, 118, 120, 122, 124, and 126 of heat transfer plate assemblies 112 are arranged in a stack 114, the first fluid conduits 304 of one bank of plate assemblies 112 may be aligned with the first fluid conduits 304 of the bank of plate assemblies 112 directly below such that the first fluid conduits 304 of the lower bank of plate assemblies 112 support the first fluid conduits 304 of the upper bank of plate assemblies 112. Similarly, the second fluid conduits 306 of the lower bank of plate assemblies 112 support the second fluid conduits 306 of the upper bank of plate assemblies 112. Thus, a respective first fluid conduit 304 of each heat transfer plate assembly 112 of the top bank 116 is disposed on a respective first fluid conduit 304 of each heat transfer plate assembly 112 of the intermediate bank 120, and a respective second fluid conduit 306 of each heat transfer plate assembly 112 of the top bank 116 is disposed on a respective second fluid conduit 306 of each heat transfer plate assembly 112 of the intermediate bank 120. Similarly, a respective first fluid conduit 304 of each heat transfer plate assembly 112 of the intermediate bank 120 is disposed on a respective first fluid conduit 304 of each heat transfer plate assembly 112 of the intermediate bank 122, and a respective second fluid conduit 306 of each heat transfer plate assembly 112 of the intermediate bank 120 is disposed on a respective second fluid conduit 306 of each heat transfer plate assembly 112 of the intermediate bank 122, and so forth.

Figure 4:
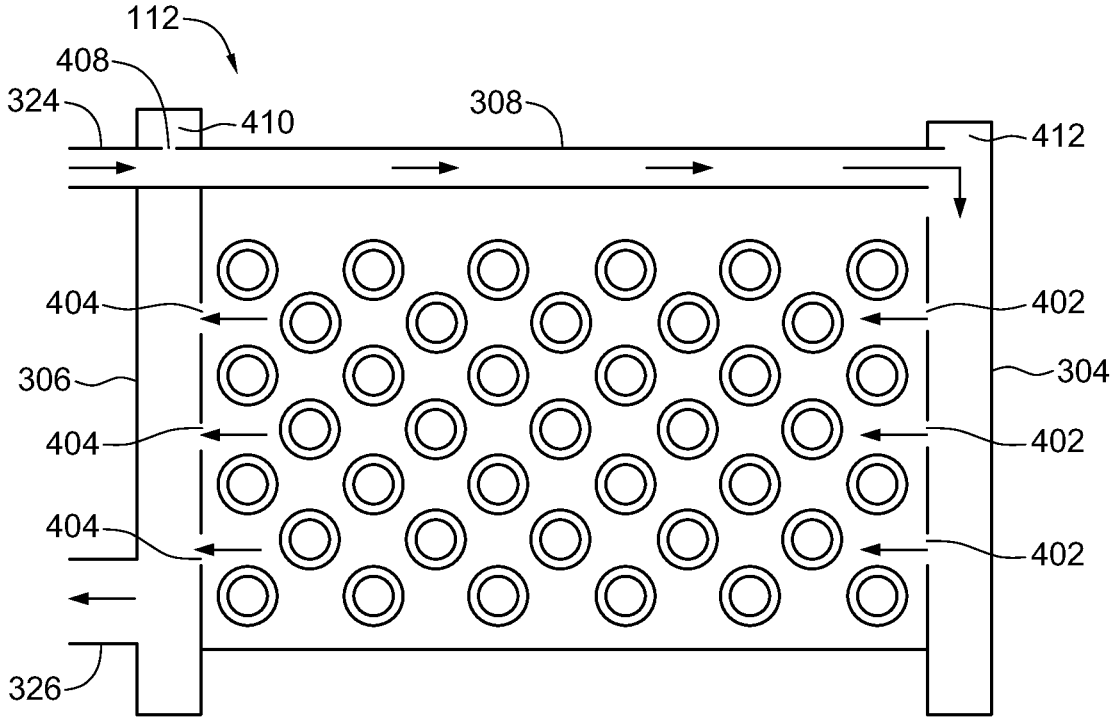
FIG. 4 is a sectional side view of the heat transfer plate assembly of FIG. 3.

Referring to FIG. 4, a side sectional view of the heat transfer plate assembly 112 of FIG. 3 is shown. The first fluid conduit 304 includes openings 402 into the heat transfer plate 302. The openings 402 are distributed along the first fluid conduit 304 at the first side 314 of the heat transfer plate 302. The openings 402 may be unevenly distributed such that the openings 402 are more closely spaced near the top of the first fluid conduit 304. Alternatively, the openings 402 may be larger near the top of the first fluid conduit 304. The second fluid conduit 306 includes openings 404 into the heat transfer plate 302. The openings 402 are distributed along the second fluid conduit 306 at the second side 318 of the heat transfer plate 302. The openings 404 may be unevenly distributed such that the openings 404 are more closely spaced near the top of the second fluid conduit 306. Alternatively, the openings 404 may be larger near the top of the second fluid conduit 306. The pipe 308 also includes an opening 408 to a top portion 410 of the second fluid conduit 306 to provide cooling fluid to the top portion 410 of the second fluid conduit 306.

The cooling fluid enters the top portion 410 of the second fluid conduit 306 through opening 408. The cooling fluid exits the pipe 308 and enters a top portion 412 of the first fluid conduit 304. The cooling fluid also enters the first fluid conduit 304. The top portion 410 of the second fluid conduit 306 and the top portion 412 of the first fluid conduit 304 may be sized to inhibit overheating of the top portions 410, 412. Thus, the top portions 410, 412 of the first and second fluid conduits 304, 306 are short enough to facilitate fluid flow and cooling of the top portion 410, 412. Additionally, fluid may flow through the top portions 410, 412 of the first and second fluid conduits 304, 306 to further cool the top portions 410, 412. With sufficient fluid flow, the top portions 410, 412 may be longer and spacing between the banks 116, 118, 120, 122, 124, and 126, that are arranged in a stack 114, may be increased.

The flow of cooling fluid through the stack 114 of heat transfer plate assemblies 112 will now be described with reference to FIG. 1 and FIG. 4. The flow of the cooling fluid through a heat transfer plate assembly 112 is illustrated by the arrows in FIG. 4. In operation, cooling fluid flows from the cooling fluid inlet manifold 132 through the respective fluid lines 136 into the respective pipes 308 of the heat transfer plate assemblies 112 of the top bank 116. For the purposes of this example, the flow of cooling fluid through one of the heat transfer plate assemblies 112 will be described with reference to FIG. 4.

Referring to FIG. 4, the cooling fluid flows through the pipe 308 of the heat transfer plate assembly 112 into the first fluid conduit 304. Cooling fluid also flows from the pipe 308, through the opening 408, and into the portion 309 of the second fluid conduit 306. From the first fluid conduit 304, the cooling fluid flows into the heat transfer plate 112 through the openings 402. The cooling fluid flows through the heat transfer plate 302 into the second fluid conduit 306, through the openings 404 in the second fluid conduit 306. The generally circular depressions 312 distributed throughout the heat transfer plate 302 facilitate the flow of the cooling fluid throughout the heat transfer plate 302. The cooling fluid then flows from the second fluid conduit 306 into the cooling fluid outlet 326.

Referring again to FIG. 1, the cooling fluid flows from the cooling fluid outlet 324 of each heat transfer plate assemblies 112 of the top bank 116, through the respective fluid lines 140, and into the respective pipes 308 of the heat transfer plate assemblies 112 of the intermediate bank 120. The cooling fluid flows through each heat transfer plate assembly 112 of the intermediate bank 120 in a similar manner as described above.

The cooling fluid then flows from the cooling fluid outlet 326 of each heat transfer plate assemblies 112 of the intermediate bank 120, through the respective fluid lines 142, and into the respective pipes 308 of the heat transfer plate assemblies 112 of the intermediate bank 122. The cooling fluid flows through each heat transfer plate assembly 112 of the intermediate bank 122 in a similar manner as described above.

The cooling fluid then flows from the cooling fluid outlet 326 of the heat transfer plate assemblies 112 of the intermediate bank 124, through the respective fluid lines 144, and into the respective pipes 308 of the heat transfer plate assemblies 112 of the intermediate bank 124. The cooling fluid flows through each heat transfer plate assembly 112 of the intermediate bank 124 in a similar manner as described above.

The cooling fluid the flows from the cooling fluid outlet 326 of each heat transfer plate assemblies 112 of the intermediate bank 124, through the respective fluid lines 146, and into the respective pipes 308 of the heat transfer plate assemblies 112 of the intermediate bank 126. The cooling fluid flows through each heat transfer plate assembly 112 of the intermediate bank 126 in a similar manner as described above.

The cooling fluid flows from the cooling fluid outlet 326 of each heat transfer plate assemblies 112 of the intermediate bank 126, through the respective fluid lines 148, and into the respective pipes 308 of the heat transfer plate assemblies 112 of the bottom bank 118. The cooling fluid flows through each heat transfer plate assembly 112 of the bottom bank 118 in a similar manner as described above. The cooling fluid flows from the cooling fluid outlet 326 of each heat transfer plate assemblies 112 of the bottom bank 118 through the respective fluid lines 138, and into the cooling fluid discharge manifold 134.

Although the flow of cooling fluid has be described herein as flowing in a downward direction through the stack 114, in an alternative embodiment the cooling inlet manifold 132 may be a cooling fluid outlet manifold, the cooling fluid inlet manifold 134 may be a cooling fluid outlet manifold, and the direction of flow of cooling fluid through the stack 114 and the heat transfer plates 112 may be in an opposite direction to that described such that the cooling fluid flows upwardly through the stack.

The operation of the heat exchanger 100 will now be described with reference to FIG. 1 to FIG. 4. When bulk solids 110 are fed into the housing 102, through the inlet 108, the bulk solids 110 flow downwardly as a result of the force of gravity from the inlet 108 into the hopper 128. The hopper 128 facilitates distribution of the bulk solids 110 onto to the top bank 116 of the stack 114 of heat transfer plate assemblies 112. The bulk solids 110 flow through passageways 206 between adjacent heat transfer plate assemblies 112, to the outlet. Bulk solids 110 that contact the pipes 308 of the heat transfer plates 302 are deflected into the passageways 206.

As the bulk solids 110 flow between adjacent heat transfer plate assemblies 112, through the passageways 206, the bulk solids 110 are cooled as the heat from the bulk solids 110 is transferred to the heat transfer plate assemblies 112 and to the cooling fluid. The cooling fluid that flows through the heat transfer plate assemblies 112 indirectly cools bulk solids 110. The cooled bulk solids 110 flow from the passageways 206, through the outlet, and into the discharge hopper 130, where the cooled bulk solids 110 are discharged under a "choked" flow. The flow of cooling fluid through the pipe 308 of each heat transfer plate assembly 112 cools the top end 316 of each heat transfer plate 302, thereby protecting the top end 316 of each heat transfer plate 302 from damage caused by heat that is transferred into the heat transfer plate 302 from the flowing high temperature bulk solids 110.

Figure 5:
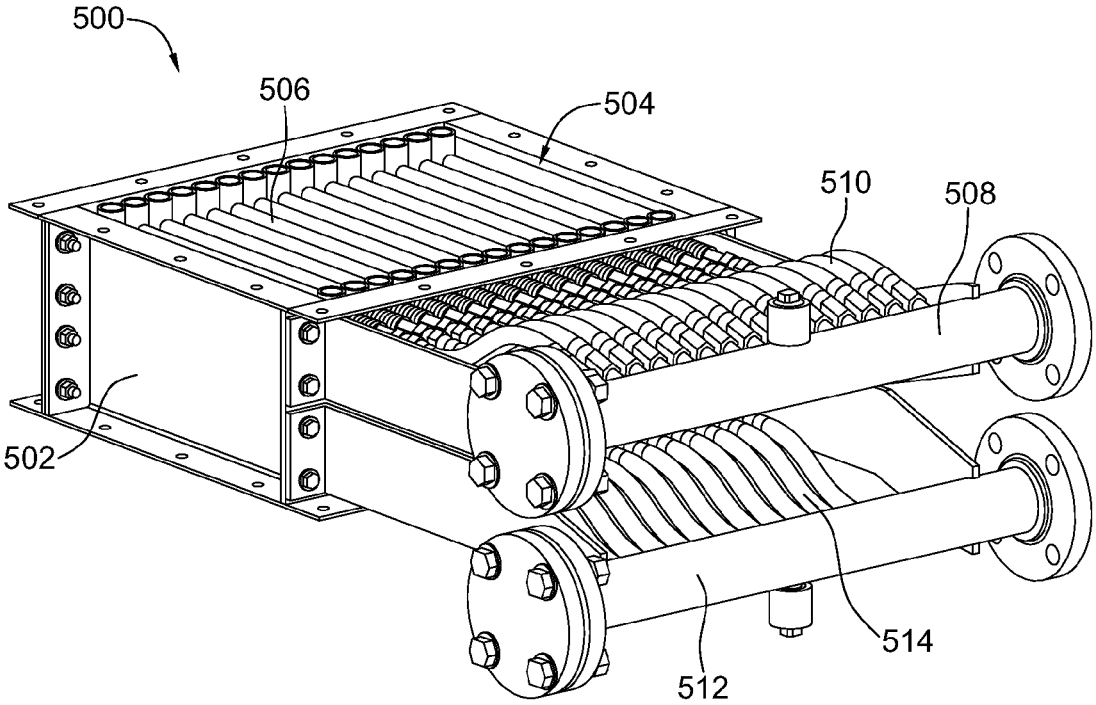
FIG. 5 is a perspective view of a portion of a heat exchanger including a single bank of heat transfer plate assemblies in accordance with another embodiment.

A perspective view of a portion of a heat exchanger including a single bank of heat transfer plate assemblies accordance with another embodiment is shown in FIG. 5. The heat exchanger 500 includes a housing 502 with a generally rectangular cross-section. A single bank 504 of heat transfer plate assemblies 506 is disposed in the housing 502. The heat transfer plate assemblies 506 are similar to the heat transfer plate assemblies 112 described above and are not described again herein.

A cooling fluid inlet manifold 508 is coupled to the housing 502 and is in fluid communication with each heat transfer plate assembly 506. A respective fluid line 510 extends from each heat transfer plate assembly 506 to the cooling fluid inlet manifold 508. A cooling fluid discharge manifold 512 is coupled to the housing 502 and is in fluid communication with each heat transfer plate assembly 506. A respective fluid line 514 extends from each heat transfer plate assembly 506 to the cooling fluid discharge manifold 512. Operation of the heat exchanger 500 is similar to that described above with reference to FIG. 1 to FIG. 4.

Although the embodiment described herein with reference to FIG. 5 includes a single bank 504 of heat transfer plate assemblies 506, in an alternative embodiment, the heat exchanger 500 may include multiple banks 504. The banks 504 may be disposed in the housing 502 and arranged in a stack. A cooling fluid inlet manifold 508 and a cooling fluid discharge manifold 512 may be coupled to each bank 504. A respective cooling fluid inlet manifold 504 may be in fluid communication with each heat transfer plate assembly 506 of a respective bank 504. A respective fluid line 510 may extend from each heat transfer plate assembly 506 of the respective banks 504 to the respective cooling fluid inlet manifolds 508. A respective cooling fluid discharge manifold 512 may be in fluid communication with each heat transfer plate assembly 506 of a respective bank 504. A respective fluid line 514 may extend from each heat transfer plate assembly 506 of the respective bans 504 to the respective cooling fluid discharge manifolds 512.

Figure 6:
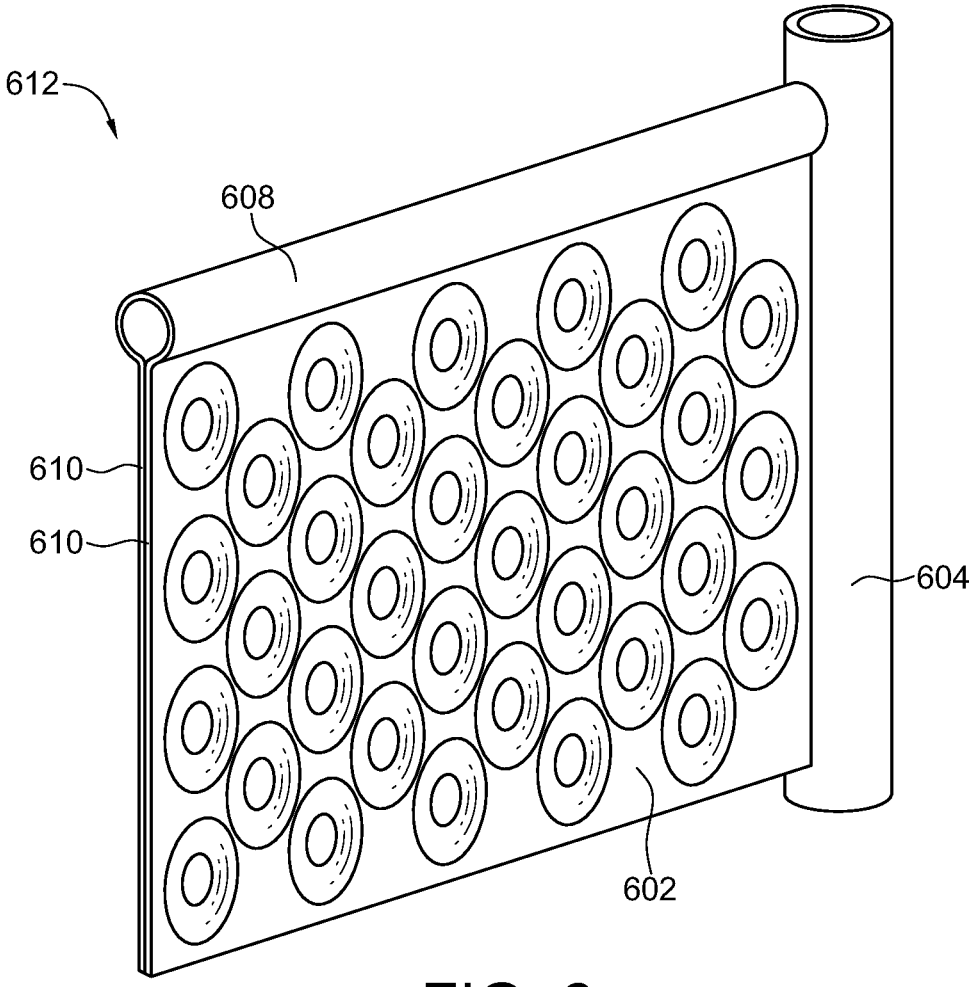
FIG. 6 is a perspective view of another example of a heat transfer plate assembly with a side cut away to show detail.
Figure 7:
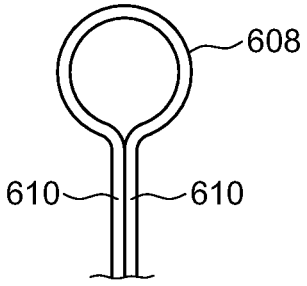
FIG. 7 is sectional view of an upper part of the heat transfer plate assembly of FIG. 6.

A perspective view of another example of a heat transfer plate assembly 612 is shown in FIG. 6 and FIG. 7. The heat transfer plate assembly 612 includes a heat transfer plate 602, a first fluid conduit 604, a second fluid conduit (not shown), and a pipe 608. A side of the heat transfer plate assembly, including the second fluid conduit, is cut away to show detail.

In the example illustrated in FIG. 6 and FIG. 7, the pair of metal sheets 610 and the pipe 608 are formed by bending a sheet of metal. The pipe 608, that is formed along the top of the metal sheets 610, may be welded along a bottom edge, which is the top edge of the metal sheets 610. As indicated above, the pipe 608 is not limited to a cylindrical pipe and may be any other suitable shape to facilitate fluid flow therethrough. In the example illustrated in FIG. 6, the pipe is not cylindrical.

The two metal sheets 610 that are formed, are generally parallel to each other and are welded as in the example described above with reference to FIG. 3. The remainder of the features of the assembly of FIG. 6 are similar to those described above with reference to FIG. 3 and are not described again in detail to avoid obscuring the description.

Figure 8:
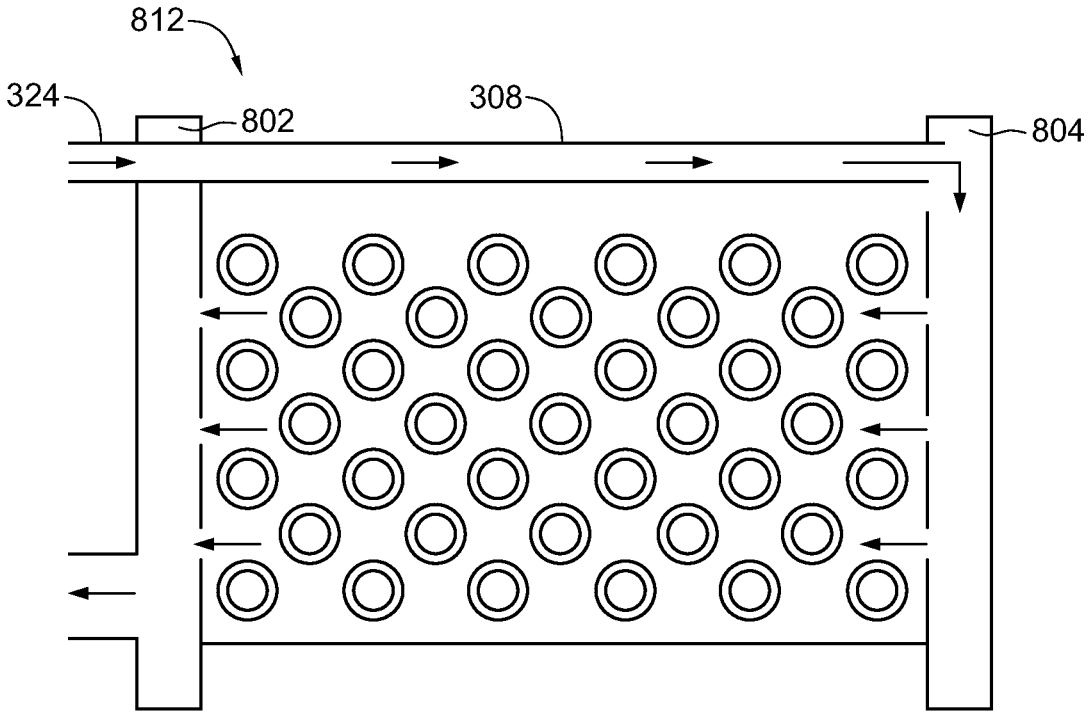
FIG. 8 is a sectional side view of another example of a heat transfer plate assembly.

Referring to FIG. 8, a side sectional view of another example of a heat transfer plate assembly 812 is shown. In this example, the pipe 308 is closed to the top portion 802 of the second fluid conduit 306 such that cooling fluid does not flow from the second end 324 of the pipe 308 into the top portion 802. The top portion 802 of the second fluid conduit 306 and the top portion 804 of the first fluid conduit 304 may be very short and the spacing between the banks of heat transfer plate assemblies 812 may be small. The size (i.e. the length) of the top portions 802, 804 may be suitably small such that cooling fluid that flows through the pipe 308 cools the top portions 802, 804 to inhibit overheating of the top portions 802, 804.

Many of the features and functions of the heat transfer plate assembly 812 are similar to the features and functions of the heat transfer plate assembly 112 described above with reference to FIG. 3 and FIG. 4 and are not described again herein to avoid obscuring the description.

Figure 9:
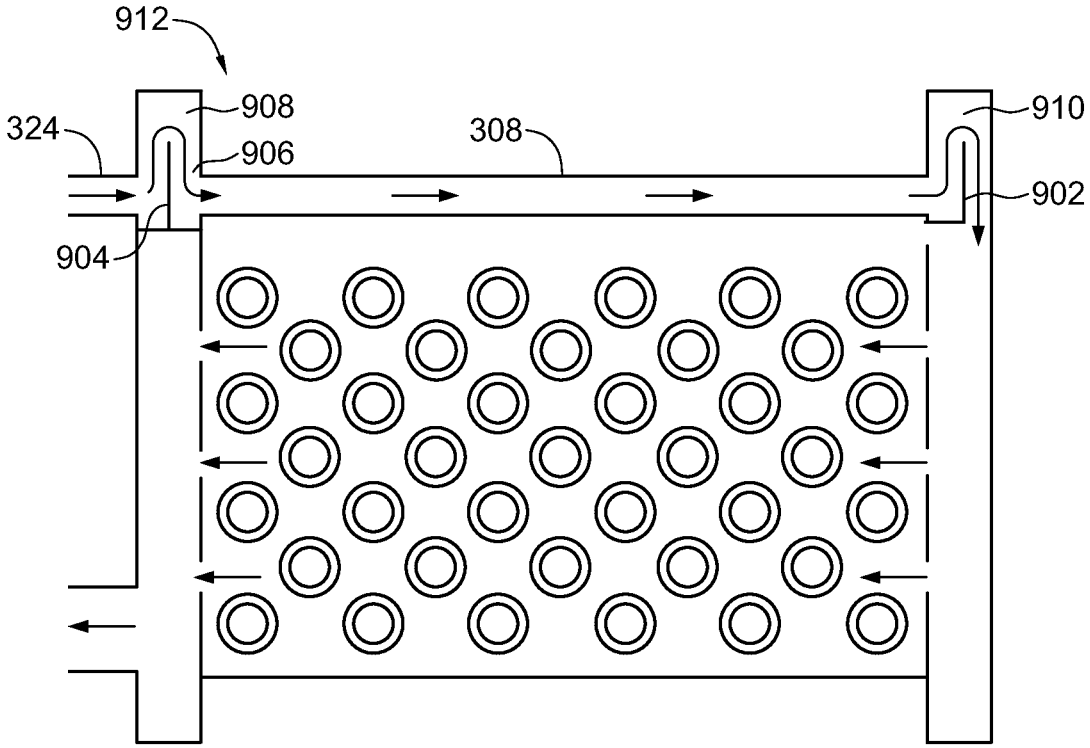
FIG. 9 is a sectional side view of still another example of a heat transfer plate assembly.

Referring to FIG. 9, a side sectional view of still another example of a heat transfer plate assembly 912 is shown. In this example, a first deflecting baffle 902 is disposed within the first fluid conduit 304 near the first end 322 of the pipe 308. A second deflecting baffle 904 is disposed within the second fluid conduit 306 near the second end 324 of the pipe 308. The second deflecting baffle 904 extends through an opening 906 in the pipe 308, into a top portion 908 of the second fluid conduit 306. The first deflecting baffle 902 diverts cooling fluid, that exits the first end 322 of the pipe 308, into the top portion 910 of the first fluid conduit 304 to facilitate the flow of cooling fluid into the top portion 910 of the first fluid conduit 304. Cooling fluid is diverted into the top portion 910 of the first fluid conduit 304 to increase the flow of cooling fluid into the top portion 910 and to inhibit overheating of the top portion 910.

The second deflecting baffle 904 diverts cooling fluid, that enters the second end 324 of the pipe 308, into the top portion 908 of the second fluid conduit 306 to facilitate the flow of cooling fluid into the top portion 908 of the second fluid conduit 306. Cooling fluid is diverted into the top portion 908 of the second fluid conduit 306 to increase the flow of cooling fluid into the top portion 908 and to inhibit overheating of the top portion 908.

By including deflection baffles 902, 904 within the first and second fluid conduits 304 and 306, respectively, the top portions 910 and 908 may be longer and the spacing between the banks of heat transfer plate assemblies 912 may be increased.

Many of the features and functions of the heat transfer plate assembly 912 are similar to the features and functions of the heat transfer plate assembly 112 described above with reference to FIG. 3 and FIG. 4 and are not described again herein to avoid obscuring the description.

Advantageously, the pipe 308 extends along the top end 314 of the heat transfer plates 302 to protect the top end 314 and the first and second sides 312, 318 of each heat transfer plate 302. The heat transfer plate includes depressions 312 to facilitate flow of cooling fluid throughout the heat transfer plate 302 during cooling of bulk solids. Operational life of the heat transfer plates 302 may be increased utilizing heat transfer plate assemblies as described.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. A heat exchanger for cooling bulk solids, the heat exchanger comprising:

a housing including an inlet for receiving the bulk solids, and an outlet for discharging the bulk solids;

a plurality of spaced apart, substantially parallel heat transfer plate assemblies disposed in the housing between the inlet and the outlet for cooling the bulk solids that flow from the inlet, between adjacent heat transfer plate assemblies, to the outlet;

ones of the heat transfer plate assemblies including:

a heat transfer plate comprising a pair of metal sheets coupled together and including spaces between the metal sheets for the flow of cooling fluid between the metal sheets;

a pipe extending along a top end of the heat transfer plate to protect the heat transfer plate, the pipe including a fluid inlet at one end thereof for receiving cooling fluid in the pipe;

a first fluid conduit extending along a first side of the heat transfer plate, the first fluid conduit in fluid communication with the pipe, near a second end of the pipe, to receive the cooling fluid from the pipe, and the first fluid conduit including first openings therein to provide fluid communication between the first fluid conduit and the heat transfer plate for the flow of the cooling fluid into the heat transfer plate;

a second fluid conduit extending along a second side of the heat transfer plate, which second side is opposite the first side, the second fluid conduit including second openings therein to provide fluid communication between the heat transfer plate and the second fluid conduit for the flow of the cooling fluid into the second fluid conduit, and a fluid outlet for the flow of the cooling fluid out of the second fluid conduit;

wherein the heat transfer plate assemblies are configured such that cooling fluid enters the heat transfer plate assembly through the fluid inlet of the pipe, and flows through the pipe to the first fluid conduit and, from the first fluid conduit, through the heat transfer plate, into the second fluid conduit, and out the fluid outlet of the second fluid conduit.

2. The heat exchanger according to claim 1, wherein the pipe is welded to the top end of the heat transfer plate.

3. The heat exchanger according to claim 1, wherein the first fluid conduit and the second fluid conduit each have a diameter that is greater than a diameter of the pipe and a thickness of the heat transfer plate.

4. The heat exchanger according to claim 3, wherein the first fluid conduit and the second fluid conduit each have a diameter that is larger than a diameter of the pipe and the first fluid conduits abut one another and the second fluid conduits abut one another such that adjacent heat transfer plate assemblies are spaced apart by the first fluid conduit and the second fluid conduit.

5. The heat exchanger according to claim 1, wherein the pipe passes through the second fluid conduit.

6. The heat exchanger according to claim 1, wherein the first fluid conduit is in fluid communication with the heat transfer plate along the first side of the heat transfer plate and the second fluid conduit is in fluid communication with the heat transfer plate along the second side of the heat transfer plate.

7. The heat exchanger according to claim 6, wherein the first openings are unevenly distributed along the first side of the heat transfer plate.

8. The heat exchanger according to claim 6, wherein the first openings are located closer to a top end of the first fluid conduit than to a bottom end of the first fluid conduit.

9. The heat exchanger according to claim 6, wherein the pipe is in fluid communication with a top end of the second fluid conduit by a third opening in the top end of the second fluid conduit to provide cooling fluid to the top end of the second fluid conduit.

10. The heat exchanger according to claim 1, comprising insulation disposed between the plurality of heat transfer plate assemblies and a sidewall of the housing to protect the sidewall.

11. The heat exchanger according to claim 1, wherein the pipe is formed on the top end of the heat transfer plate.

12. The heat exchanger according to claim 1, wherein the pair of metal sheets are welded together to facilitate fluid flow between the metal sheets.

13. The heat exchanger according to claim 12, wherein the pair of metal sheets are formed from a single sheet of metal.

14. The heat exchanger according to claim 12, wherein the pair of metal sheets and the pipe are formed from a single sheet of metal.

15. The heat exchanger according to claim 6, wherein the first fluid conduit comprises a first deflecting baffle to provide cooling fluid into an end of the first fluid conduit.

16. The heat exchanger according to claim 15, wherein the pipe is in fluid communication with an end of the second fluid conduit by a third opening in the end of the second fluid conduit, and wherein the second fluid conduit comprises a second deflecting baffle that extends through the third opening to provide cooling fluid to the end of the second fluid conduit.

17. A heat transfer plate assembly for a heat exchanger comprising:

a heat transfer plate for cooling bulk solids, the heat transfer plate having a top end, a bottom end, a first side, and an opposing second side, the heat transfer plate comprising a pair of metal sheets coupled together and including spaces between the metal sheets for the flow of cooling fluid between the metal sheets;

a pipe extending along a top end of the heat transfer plate to protect the heat transfer plate, the pipe including a fluid inlet at one end thereof for receiving cooling fluid in the pipe;

a first fluid conduit extending along a first side of the heat transfer plate, the first fluid conduit in fluid communication with the pipe, near a second end of the pipe, to receive the cooling fluid from the pipe, and the first fluid conduit including first openings therein to provide fluid communication between the first fluid conduit and the heat transfer plate for the flow of the cooling fluid into the heat transfer plate;

a second fluid conduit extending along a second side of the heat transfer plate, which second side is opposite the first side, the second fluid conduit including second openings therein to provide fluid communication between the heat transfer plate and the second fluid conduit for the flow of the cooling fluid into the second fluid conduit, and a fluid outlet for the flow of the cooling fluid out of the second fluid conduit;

wherein the heat transfer plate assembly is configured such that cooling fluid enters the heat transfer plate assembly through the fluid inlet of the pipe, and flows through the pipe to the first fluid conduit and, from the first fluid conduit, through the heat transfer plate, into the second fluid conduit, and out the fluid outlet of the second fluid conduit.

18. The heat transfer plate assembly of claim 17, wherein the pipe is welded to the top end of the heat transfer plate.

19. The heat transfer plate assembly according to claim 17, wherein the first fluid conduit and the second fluid conduit each have a diameter that is greater than a diameter of the pipe and a thickness of the heat transfer plate.

20. The heat transfer plate assembly according to claim 17, wherein the first end of the pipe is in fluid communication with the first second fluid conduit.

21. The heat transfer plate assembly according to claim 20, wherein the pipe passes through the second fluid conduit.

22. The heat transfer plate assembly according to claim 17, wherein the first fluid conduit is in fluid communication with the heat transfer plate along the first side of the heat transfer plate, and the second fluid conduit is in fluid communication with the heat transfer plate along the second side of the heat transfer plate.

23. The heat transfer plate assembly according to claim 22, wherein the pipe is in fluid communication with a top end of the second fluid conduit through a third opening in the top end of the second fluid conduit to provide cooling fluid to top end of the second fluid conduit.

24. The heat transfer plate assembly according to claim 22, wherein the first openings are unevenly distributed along the first side of the heat transfer plate.

25. The heat transfer plate assembly according to claim 22, wherein the the first openings are located closer to the top end of the first fluid conduit than to a bottom end of the first fluid conduit.

26. The heat transfer plate assembly according to claim 24, wherein the second openings unevenly are distributed along the second side of the heat transfer plate.

27. The heat transfer plate assembly according to claim 25, wherein the the second openings are located closer to the top end of the second fluid conduit than to a bottom end of the second fluid conduit.

28. The heat transfer plate assembly according to claim 17, wherein the pipe is formed on the top end of the heat transfer plate.

29. The heat transfer plate assembly according to claim 17, wherein the metal sheets are welded together to facilitate fluid flow between the metal sheets.

30. The heat transfer plate assembly according to claim 29, wherein the pair of metal sheets are formed from a single sheet of metal.

31. The heat transfer plate assembly according to claim 29, wherein the pair of metal sheets and the pipe are formed from a single sheet of metal.

32. The heat transfer plate assembly according to claim 22, wherein the first fluid conduit comprises a first deflecting baffle to provide cooling fluid into an end of the first fluid conduit.

33. The heat transfer plate assembly according to claim 32, wherein the pipe is in fluid communication with an end of the second fluid conduit by a third opening in the end of the second fluid conduit, and wherein the second fluid conduit comprises a second deflecting baffle that extends through the third opening to provide cooling fluid to the end of the second fluid conduit.

* * * * *